US008939562B2

(12) United States Patent
Koike et al.

(10) Patent No.: US 8,939,562 B2
(45) Date of Patent: Jan. 27, 2015

(54) LIQUID DISCHARGING APPARATUS AND CONTROL METHOD THEREOF

(71) Applicant: Seiko Epson Corporation, Tokyo (JP)

(72) Inventors: Kaoru Koike, Matsumoto (JP); Toshio Kumagai, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/184,468

(22) Filed: Feb. 19, 2014

(65) Prior Publication Data

US 2014/0168296 A1 Jun. 19, 2014

Related U.S. Application Data

(63) Continuation of application No. 13/410,064, filed on Mar. 1, 2012, now Pat. No. 8,690,301.

(30) Foreign Application Priority Data

Mar. 4, 2011 (JP) ..... 2011-047523

(51) Int. Cl.
*B41J 2/175* (2006.01)
*B41J 2/165* (2006.01)

(52) U.S. Cl.
CPC ..... *B41J 2/175* (2013.01); *B41J 2/16505* (2013.01)
USPC ..... 347/89; 347/5

(58) Field of Classification Search
USPC ..... 347/5–7, 20, 22, 29, 87, 89
See application file for complete search history.

(56) References Cited

U.S. PATENT DOCUMENTS

| | | | |
|---|---|---|---|
| 5,847,736 | A | 12/1998 | Kanbayashi et al. |
| 6,007,193 | A | 12/1999 | Kashimura et al. |
| 6,231,174 | B1 | 5/2001 | Haigo |
| 2003/0227524 | A1 | 12/2003 | Yamada |
| 2005/0116999 | A1 | 6/2005 | Ando et al. |
| 2008/0158307 | A1 | 7/2008 | Nitta et al. |
| 2008/0225090 | A1 | 9/2008 | Kobayashi |
| 2008/0239013 | A1 | 10/2008 | Hirashima |
| 2009/0002467 | A1 | 1/2009 | Watanabe |
| 2009/0160887 | A1 | 6/2009 | Hamazaki et al. |
| 2010/0103208 | A1 | 4/2010 | Asami et al. |

(Continued)

FOREIGN PATENT DOCUMENTS

| | | |
|---|---|---|
| JP | 05-330073 | 12/1993 |
| JP | 07-164640 | 6/1995 |

(Continued)

OTHER PUBLICATIONS

Extended European Search Report dated Jun. 13, 2012 European Patent Application No. 12157885.0.

*Primary Examiner* — Julian Huffman
*Assistant Examiner* — Sharon A Polk
(74) *Attorney, Agent, or Firm* — Workman Nydegger

(57) ABSTRACT

When filling a printing head with ink, ink in a sub-tank is circulated through a forward path port, a forward path, the printing head, a return path, a return path port, and the sub-tank by pumping ink from the forward path port side to the printing head side by a circulation pump in a state where a plurality of nozzles is sealed by bringing a contact member of a capping device into contact with a nozzle formation surface. Thereafter, sealing of the plurality of nozzles by the capping device is released while pressurizing the sub-tank by a pressure adjusting device.

5 Claims, 6 Drawing Sheets

(56) References Cited

U.S. PATENT DOCUMENTS

| | | | | |
|---|---|---|---|---|
| 2011/0050794 | A1 | 3/2011 | Koike et al. | |
| 2011/0050813 | A1 * | 3/2011 | Pan et al. | 347/85 |

FOREIGN PATENT DOCUMENTS

| | | | |
|---|---|---|---|
| JP | 10-029317 | | 2/1998 |
| JP | 10-230623 | | 9/1998 |
| JP | 11-198403 | | 7/1999 |
| JP | 11-342634 | | 12/1999 |
| JP | 2000-033714 | | 2/2000 |
| JP | 2005-125667 | | 5/2005 |
| JP | 2006-247899 | | 9/2006 |
| JP | 2008-246843 | | 10/2008 |
| JP | 4270300 | | 3/2009 |
| JP | 4337500 | | 7/2009 |
| JP | 2010-105169 | | 5/2010 |
| JP | 2011-051171 | | 3/2011 |
| JP | 2012-000883 | A | 1/2012 |
| WO | 95/31335 | | 11/1995 |

* cited by examiner

LIQUID DISCHARGING APPARATUS AND CONTROL METHOD THEREOF

CROSS REFERENCES TO RELATED APPLICATIONS

This application is a Continuation of U.S. patent application Ser. No. 13/410,064 filed Mar. 1, 2012 (which patent application is incorporated herein by reference in its entirety), which claims the benefit of Japanese Patent Application No. 2011-47523, filed Mar. 4, 2011 (which patent application is also expressly incorporated herein by reference in its entirety).

BACKGROUND

1. Technical Field

The present invention relates to a liquid discharging apparatus and a method of controlling the liquid discharging apparatus.

2. Related Art

In the past, as a liquid discharging apparatus of this type, a liquid discharging apparatus has been proposed which includes a print head which ejects ink, an ink tank which accommodates ink, a first ink flow path for supplying ink from the ink tank to a manifold of the print head, a second ink flow path for recovering ink from the manifold to the ink tank, a pump for ink circulation provided in the first ink flow path, an opening-closing valve provided in the second ink flow path, a suction cap for covering a nozzle surface of the print head, and a pump for suction connected to the suction cap through a suction pipe (refer to JP-A-2000-33714, for example). In this apparatus, when filling the print head with ink, first, the nozzle surface of the print head is covered by the suction cap and also the opening-closing valve is opened, and the pump for ink circulation is then rotationally driven, whereby ink is circulated in a circulation flow path composed of the first ink flow path, the manifold, and the second ink flow path. Thereafter, the opening-closing valve is closed and also the pump for ink circulation is stopped in a state where it does not block the first ink flow path, and the pump for suction is then driven, whereby ink in the print head is suctioned and each pressure chamber of the print head is then filled with ink.

The suction cap generally is for covering the nozzle surface when suctioning ink from the print head, or the like, and forms a closed space along with the nozzle surface when covering the nozzle surface. For this reason, when filling the print head with ink, in a case where the pump for circulation is rotationally driven in a state where the nozzle surface is covered by the suction cap, depending on the flow velocity of ink, there is a case where ink may be leaked from nozzles.

SUMMARY

An advantage of some aspects of the invention is that it suppresses waste of liquid when filling a discharging head including a plurality of nozzles with liquid in a liquid discharging apparatus and a method of controlling the liquid discharging apparatus.

According to a first aspect of the invention, there is provided a liquid discharging apparatus that is provided with a discharging head having a plurality of nozzles which discharge liquid, including: a storage section which stores liquid; a circulation path configured to include the discharging head and having an opening end portion on one side and an opening end portion on the other side which are disposed together in the storage section; a pumping section which is provided further on the opening end portion side on one side than the discharging head in the circulation path and is capable of pumping liquid such that liquid circulates in the circulation path; a sealing section capable of independently sealing each of the plurality of nozzles; a pressurization section capable of pressurizing the storage section; and a control-during-filling section which executes first control in which the sealing section and the pumping section are controlled such that liquid circulates in the circulation path by driving of the pumping section in a state where each of the plurality of nozzles is independently sealed by the sealing section, when filling the discharging head with liquid, and executes second control in which the pressurization section and the sealing section are controlled such that sealing of the plurality of nozzles by the sealing section is released while the storage section is pressurized by the pressurization section, after the execution of the first control.

In the liquid discharging apparatus according to the first aspect of the invention, when filling the discharging head with liquid, the first control in which the sealing section and the pumping section are controlled such that liquid circulates in the circulation path by driving of the pumping section in a state where each of the plurality of nozzles is independently sealed by the sealing section is executed, and after the execution of the first control, the second control in which the pressurization section and the sealing section are controlled such that sealing of the plurality of nozzles by the sealing section is released while the storage section is pressurized by the pressurization section is executed. First, as the first control, by circulating liquid in the circulation path in a state where the plurality of nozzles is sealed, it is possible to fill the discharging head with liquid while inhibiting discharge (leakage) of liquid from the plurality of nozzles. At this time, depending on the shapes or the like of the plurality of nozzles, there is a possibility that gas (air bubbles) in the plurality of nozzles may remain as it is without moving to the opening end portion side. However, as the second control, by releasing sealing of the plurality of nozzles while pressurizing the storage section, it is possible to discharge gas along with liquid from the plurality of nozzles. By these successive controls, it is possible to suppress waste of liquid when filling the discharging head including the plurality of nozzles with liquid and it is also possible to sufficiently remove gas in the circulation path (including the plurality of nozzles). In addition, as the first control, since liquid is circulated in the circulation path while sealing the plurality of nozzles, it becomes possible to make the flow rate of liquid relatively large. Here, the "sealing section" may also be a section which comes into contact with the nozzle formation surface with the plurality of nozzles formed therein, thereby being capable of independently sealing each of the plurality of nozzles.

In the liquid discharging apparatus according to the first aspect of the invention, the control-during-filling section may be a section of controlling the pumping section, the pressurization section, and the sealing section such that sealing of the plurality of nozzles by the sealing section is released while the storage section is pressurized by the pressurization section and liquid circulates in the circulation path by driving of the pumping section, as the second control.

According to a second aspect of the invention, there is provided a liquid discharging apparatus that is provided with a discharging head having a plurality of nozzles which discharge liquid, including: a storage section which stores liquid; a circulation path configured to include the discharging head and having an opening end portion on one side and an opening end portion on the other side which are disposed together in the storage section; a pumping section which is provided further on the opening end portion side on one side than the discharging head in the circulation path and is capable of pumping liquid such that liquid circulates in the circulation path; a sealing section capable of independently sealing each of the plurality of nozzles; and a control-during-filling section which executes first control in which the sealing section and the pumping section are controlled such that liquid circulates in the circulation path by driving of the pumping section in a state where each of the plurality of nozzles is independently sealed by the sealing section, when filling the discharging head with liquid, and executes second control in which the pumping section and the sealing section are controlled such that sealing of the plurality of nozzles by the sealing section is released while liquid circulates in the circulation path by driving of the pumping section, after the execution of the first control.

In the liquid discharging apparatus according to the second aspect of the invention, when filling the discharging head with liquid, the first control in which the sealing section and the pumping section are controlled such that liquid circulates in the circulation path by driving of the pumping section in a state where each of the plurality of nozzles is independently sealed by the sealing section is executed, and after the execution of the first control, the second control in which the pumping section and the sealing section are controlled such that sealing of the plurality of nozzles by the sealing section is released while liquid circulates in the circulation path by driving of the pumping section is executed. First, as the first control, by circulating liquid in the circulation path in a state where the plurality of nozzles is sealed, it is possible to fill the discharging head with liquid while inhibiting discharge (leakage) of liquid from the plurality of nozzles. At this time, depending on the shapes or the like of the plurality of nozzles, there is a possibility that gas (air bubbles) in the plurality of nozzles may remain as it is without moving to the opening end portion side. However, as the second control, by releasing sealing of the plurality of nozzles while circulating liquid in the circulation path, it is possible to discharge gas along with liquid from the plurality of nozzles. By these successive controls, it is possible to suppress waste of liquid when filling the discharging head including the plurality of nozzles with liquid and it is also possible to sufficiently remove gas in the circulation path (including the plurality of nozzles). In addition, as the first control, since liquid is circulated in the circulation path while sealing the plurality of nozzles, it becomes possible to make the flow rate of liquid relatively large. Here, the "sealing section" may also be a section which comes into contact with the nozzle formation surface with the plurality of nozzles formed therein, thereby be capable of independently sealing each of the plurality of nozzles.

In the liquid discharging apparatus according to the first or second aspect of the invention, the control-during-filling section may be a section of controlling the pumping section such that liquid equal to or more than the plurality times the entire volume of the circulation path circulates in the circulation path, as the first control. Further, the control-during-filling section may be a section of controlling the pumping section such that liquid circulates over the plurality times in the circulation path, as the first control. In these cases, it is possible to more reliably discharge gas (air bubbles) in the circulation path to the storage section.

Further, in the liquid discharging apparatus according to the first or second aspect of the invention, the opening end portion on one side may be disposed at a position lower than the opening end portion on the other side, and the control-during-filling section may be a section of controlling the pumping section such that liquid circulates from the opening end portion side on one side to the opening end portion side on the other side by way of the discharging head, when controlling the pumping section such that liquid circulates in the circulation path. According to this, it is possible to suppress inflow of gas (air bubbles) from the storage section to the circulation path at the time of execution of the first control.

According to a third aspect of the invention, there is provided a method of controlling a liquid discharging apparatus that includes a discharging head having a plurality of nozzles which discharge liquid, a storage section which stores liquid, a circulation path configured to include the discharging head and having an opening end portion on one side and an opening end portion on the other side which are disposed together in the storage section, a pumping section which is provided further on the opening end portion side on one side than the discharging head in the circulation path and is capable of pumping liquid such that liquid circulates in the circulation path, a sealing section capable of independently sealing each of the plurality of nozzles, and a pressurization section capable of pressurizing the storage section, the method including: executing first control in which the sealing section and the pumping section are controlled such that liquid circulates in the circulation path by driving of the pumping section in a state where each of the plurality of nozzles is independently sealed by the sealing section, when filling the discharging head with liquid; and executing second control in which the pressurization section and the sealing section are controlled such that sealing of the plurality of nozzles by the sealing section is released while the storage section is pressurized by the pressurization section, after the execution of the first control.

In the method of controlling a liquid discharging apparatus according to the third aspect of the invention, when filling the discharging head with liquid, the first control in which the sealing section and the pumping section are controlled such that liquid circulates in the circulation path by driving of the pumping section in a state where each of the plurality of nozzles is independently sealed by the sealing section is executed, and after the execution of the first control, the second control in which the pressurization section and the sealing section are controlled such that sealing of the plurality of nozzles by the sealing section is released while the storage section is pressurized by the pressurization section is executed. First, as the first control, by circulating liquid in the circulation path in a state where the plurality of nozzles is sealed, it is possible to fill the discharging head with liquid while inhibiting discharge (leakage) of liquid from the plurality of nozzles. At this time, depending on the shapes or the like of the plurality of nozzles, there is a possibility that gas (air bubbles) in the plurality of nozzles may remain as it is without moving to the opening end portion side. However, as the second control, by releasing sealing of the plurality of nozzles while pressurizing the storage section, it is possible to discharge gas along with liquid from the plurality of nozzles. By these successive controls, it is possible to suppress waste of liquid when filling the discharging head including the plurality of nozzles with liquid and it is also possible to sufficiently remove gas in the circulation path (including the plurality of nozzles). In addition, as the first control, since liquid is circulated in the circulation path while sealing the plurality of nozzles, it becomes possible to make the flow rate of liquid relatively large.

According to a fourth aspect of the invention, there is provided a method of controlling a liquid discharging apparatus that includes a discharging head having a plurality of nozzles which discharge liquid, a storage section which stores liquid, a circulation path configured to include the discharging head and having an opening end portion on one side and an opening end portion on the other side which are disposed together in the storage section, a pumping section which is provided further on the opening end portion side on one side than the discharging head in the circulation path and is capable of pumping liquid such that liquid circulates in the circulation path, and a sealing section capable of independently sealing each of the plurality of nozzles, the method including: executing first control in which the sealing section and the pumping section are controlled such that liquid circulates in the circulation path by driving of the pumping section in a state where each of the plurality of nozzles is independently sealed by the sealing section, when filling the discharging head with liquid; and executing second control in which the pumping section and the sealing section are controlled such that sealing of the plurality of nozzles by the sealing section is released while liquid circulates in the circulation path by driving of the pumping section, after the execution of the first control.

In the method of controlling a liquid discharging apparatus according to the fourth aspect of the invention, when filling the discharging head with liquid, the first control in which the sealing section and the pumping section are controlled such that liquid circulates in the circulation path by driving of the pumping section in a state where each of the plurality of nozzles is independently sealed by the sealing section is executed, and after the execution of the first control, the second control in which the pumping section and the sealing section are controlled such that sealing of the plurality of nozzles by the sealing section is released while liquid circulates in the circulation path by driving of the pumping section is executed. First, as the first control, by circulating liquid in the circulation path in a state where the plurality of nozzles is sealed, it is possible to fill the discharging head with liquid while inhibiting discharge (leakage) of liquid from the plurality of nozzles. At this time, depending on the shapes or the like of the plurality of nozzles, there is a possibility that gas (air bubbles) in the plurality of nozzles may remain as it is without moving to the opening end portion side. However, as the second control, by releasing sealing of the plurality of nozzles while circulating liquid in the circulation path, it is possible to discharge gas along with liquid from the plurality of nozzles. By these successive controls, it is possible to suppress waste of liquid when filling the discharging head including the plurality of nozzles with liquid and it is also possible to sufficiently remove gas in the circulation path (including the plurality of nozzles). In addition, as the first control, since liquid is circulated in the circulation path while sealing the plurality of nozzles, it becomes possible to make the flow rate of liquid relatively large.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
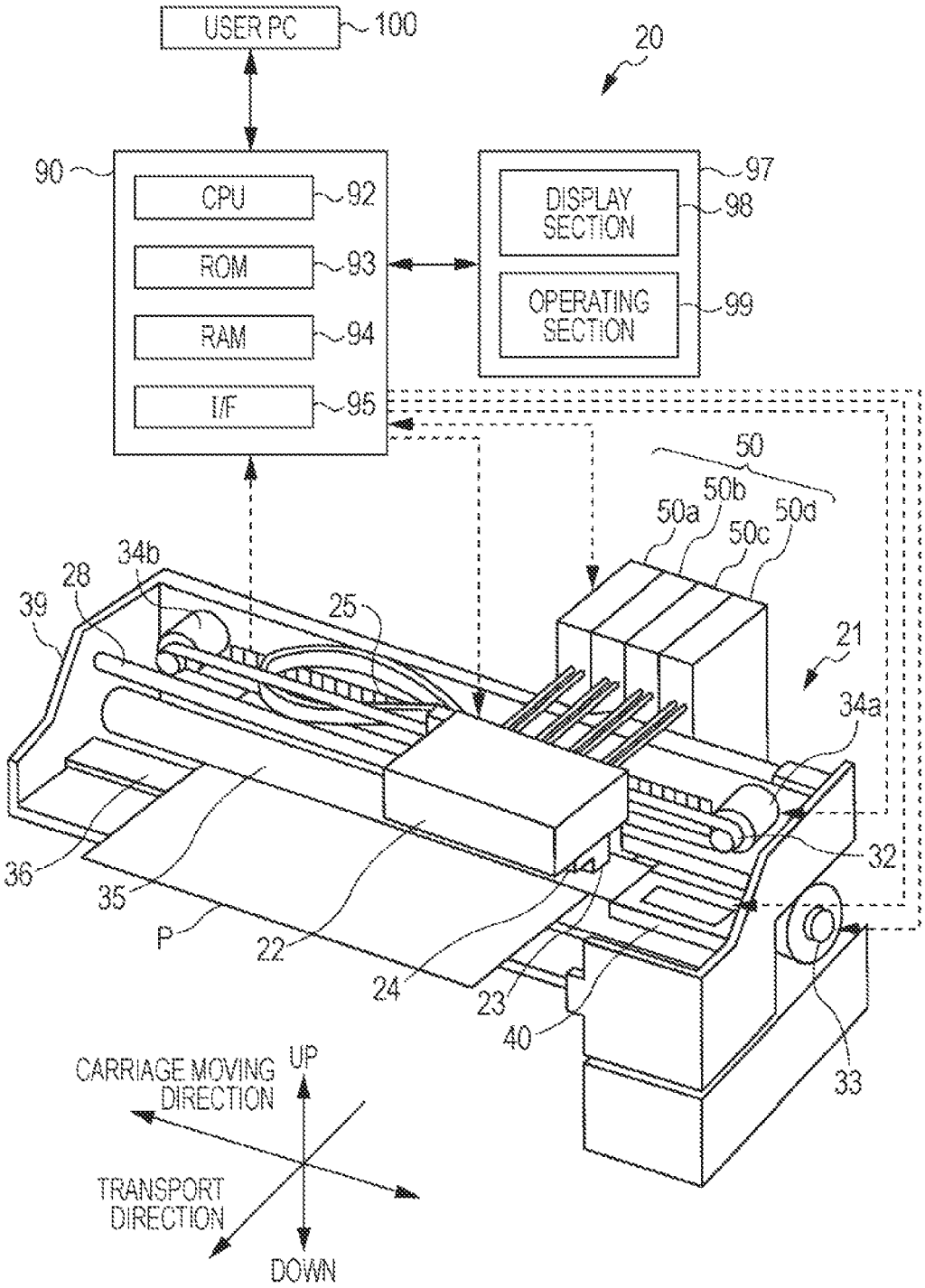
FIG. 1 is a configuration diagram showing an outline of the configuration of an ink jet printer.

Next, embodiments of the invention will be described using the drawings. FIG. 1 is a configuration diagram showing an outline of the configuration of an ink jet printer 20 related to an embodiment of the invention, FIG. 2 is a configuration diagram showing an outline of the configuration of an ink circulation system 50, and FIG. 3 is a configuration diagram showing an outline of the configuration of a capping device 40.

As shown in FIG. 1, the ink jet printer 20 related to this embodiment includes a printer mechanism 21 which performs print processing by discharging ink droplets from a plurality of nozzles 23 formed in a printing head 24 onto paper P which is transported on a platen 36, a capping device 40 which is disposed in the vicinity of the right end of the platen 36, thereby being capable of independently sealing each of the plurality of nozzles 23 of the printing head 24, a controller 90 which controls the whole apparatus, and an operating panel 97 having a display section 98 for informing a user of a variety of information or an operating section 99 to which a user inputs various instructions.

The printer mechanism 21 includes a paper feed roller 35 which is driven by a driving motor 33, thereby transporting the paper P on the platen 36 from the back side in the drawing to the front side, a carriage 22 which is attached to a carriage belt 32 and reciprocates in the left-and-right direction (a main scanning direction) along a guide 28, a linear type encoder 25 which detects the position of the carriage 22, the printing head 24 which is provided at the lower portion of the carriage 22 and in which the plurality of nozzles 23 is formed, and ink circulation systems 50*a* to 50*d* (hereinafter sometimes collectively referred to as an ink circulation system 50) which respectively circulate cyan (C), magenta (M), yellow (Y), and black (K) ink by way of the printing head 24. Here, the carriage 22 is attached to the carriage belt 32 spanned between a carriage motor 34*a* mounted on the right side of a mechanical frame 39 and a driven roller 34*b* mounted on the left side of the mechanical frame 39 and reciprocates in the left-and-right direction along the guide 28 by driving of the carriage belt 32 by the carriage motor 34*a*. Further, the printing head 24 may also use the system of pressurizing ink by deforming a built-in piezoelectric element by application of voltage to the piezoelectric element and may also use the system of pressurizing ink by air bubbles generated by heating the ink by application of voltage to a heat generation resistor (for example, a heater or the like).

Figure 2:
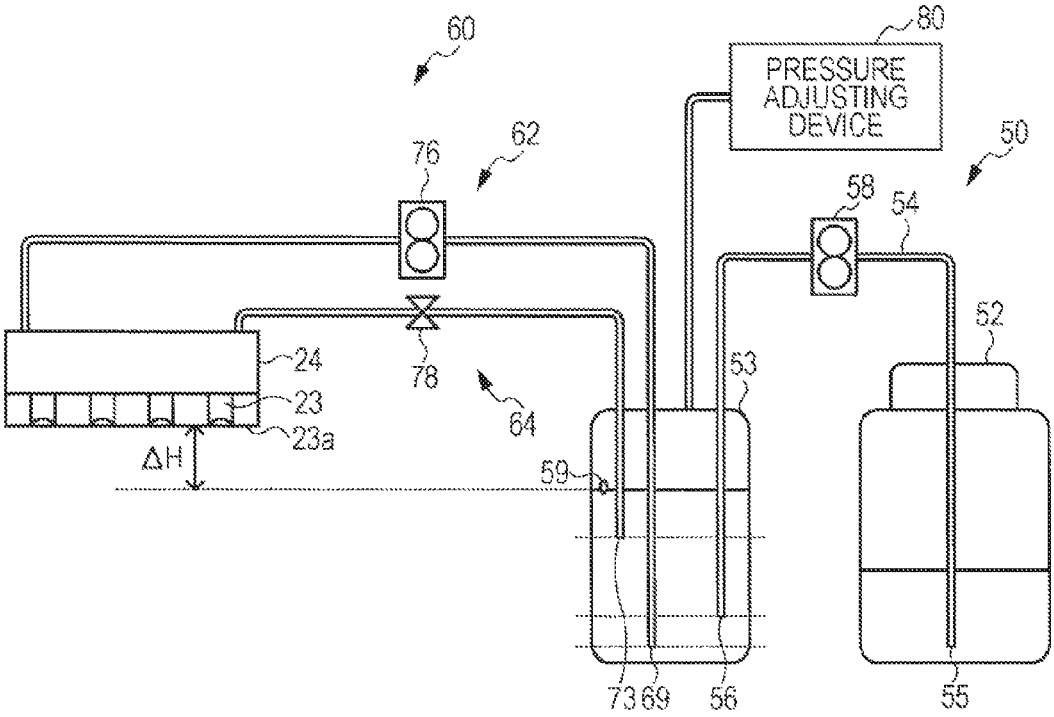
FIG. 2 is a configuration diagram showing an outline of the configuration of an ink circulation system.
Figure 3:
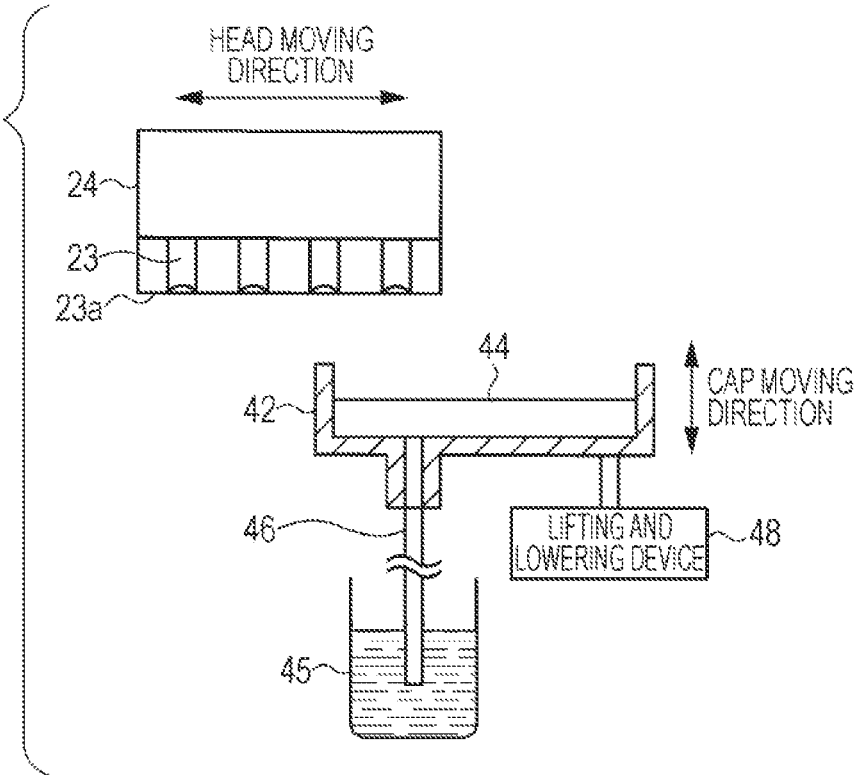
FIG. 3 is a configuration diagram showing an outline of the configuration of a capping device.

As shown in FIG. 2, the ink circulation system 50 includes a main tank 52 in which ink is stored, a sub-tank 53 which temporarily stores ink, a supply path 54 having an opening end portion (hereinafter referred to as a supply source port) 55 on one side disposed in the main tank 52 and an opening end portion (hereinafter referred to as a supply port) 56 on the other side disposed in the sub-tank 53, a supply pump 58 which is provided in the supply path 54 and is capable of pumping liquid, a circulation path 60 which is configured to include the printing head 24 and has an opening end portion (hereinafter referred to as a forward path port) 69 on one side and an opening end portion (hereinafter referred to as a return path port) 73 on the other side which are disposed together in the sub-tank 53, a circulation pump 76 which is provided further on the forward path port 69 side (hereinafter, this portion is referred to as a forward path 62) than the printing head 24 in the circulation path 60 and is capable of pumping liquid, an opening-closing valve 78 which is provided further on the return path port 73 side (hereinafter, this portion is referred to as a return path 64) than the printing head 24 in the circulation path 60 and is capable of being opened and closed, and a pressure adjusting device 80 which is capable of making the sub-tank 53 be opened to the air or pressurizing the sub-tank 53.

The sub-tank 53 or the forward path port 69 and the return path port 73 of the circulation path 60 are disposed at a position lower than the printing head 24 when viewed in the direction of gravitational force. Further, the forward path port 69 of the circulation path 60, the return path port 73 of the circulation path 60, and the supply port 56 of the supply path 54 are disposed in such a manner that the return path port 73 of the circulation path 60, the supply port 56 of the supply path 54, and the forward path port 69 of the circulation path 60 are disposed in order from the high side when viewed in the direction of gravitational force.

The supply pump 58 is configured as a gear pump and made so as to be capable of pumping ink from the main tank 52 side to the sub-tank 53 side by rotation (hereinafter, this is referred to as rotation in the normal rotation direction) in a given direction (for example, the clockwise direction) and also capable of pumping ink from the sub-tank 53 side to the main tank 52 side by rotation (hereinafter, this is referred to as rotation in the reverse rotation direction) in the opposite direction (for example, the counterclockwise direction) to the given direction.

The circulation pump 76 is configured as a gear pump, similarly to the supply pump 58, and made so as to be capable of pumping ink from the forward path port 69 side to the printing head 24 side by rotation (hereinafter, this is referred to as rotation in the normal rotation direction) in a given direction (for example, the clockwise direction) and also capable of pumping ink from the printing head 24 side to the forward path port 69 side by rotation (hereinafter, this is referred to as rotation in the reverse rotation direction) in the opposite direction (for example, the counterclockwise direction) to the given direction. In addition, the circulation pump 76 is configured so as not to block the circulation path 60 at the time of the stop of driving.

Figure 4:
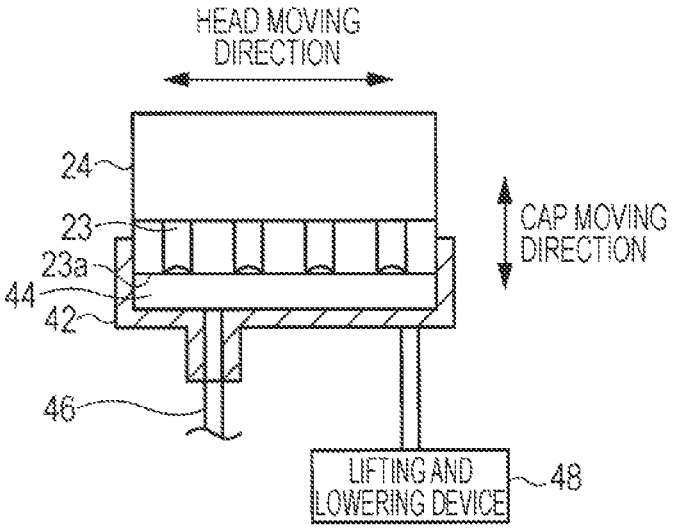
FIG. 4 is an explanatory diagram showing the state of sealing a plurality of nozzles.

As shown in FIG. 3, the capping device 40 includes an approximately rectangular parallelepiped-shaped cap 42 having an opened upper portion, a contact member 44 which is formed of, for example, rubber or the like, disposed inside the cap 42, and can come into contact with the surface (hereinafter referred to as a nozzle formation surface 23*a*) of the printing head 24, in which the plurality of nozzles 23 is formed, a discharge path 46 which connects the bottom portion of the cap 42 and a waste liquid tank 45, and a lifting and lowering device 48 which moves the cap 42 up and down in order to perform contact of the contact member 44 with the nozzle formation surface 23*a* or release thereof. The capping device 40 is made so as to be capable of sealing all the nozzles 23 (be capable of independently sealing each of the plurality of nozzles 23) by raising the cap 42 by the lifting and lowering device 48 such that the contact member 44 comes into contact with the nozzle formation surface 23*a*, when the printing head 24 has moved along with the carriage 22 to a position (a so-called home position) above the capping device 40. The state of sealing the plurality of nozzles 23 by the capping device 40 is shown in FIG. 4. Further, in the capping device 40, in a case where ink is discharged from the plurality of nozzles 23 in a state where the nozzle formation surface 23*a* and the contact member 44 are separated slightly (several mm or the like) from each other, so that a closed space is formed by the nozzle formation surface 23*a* and the cap 42, the ink is discharged to the waste liquid tank 45 by way of the clearance between the cap 42 and the contact member 44 or the discharge path 46.

As shown in FIG. 1, the controller 90 is configured as a microprocessor centering around a CPU 92 and includes a ROM 93 in which various processing programs are stored, a RAM 94 which temporarily stores data, an interface (I/F) 95 which performs exchange of information with an external apparatus, and an input/output port (not shown). In the RAM 94, a print buffer area is provided, and in the print buffer area, printing data sent from a user PC 100 through the I/F 95 is stored. A position detection signal from the linear type encoder 25, a switch signal from a float switch 59 (refer to FIG. 2) which is turned on in a case where the position (height) of the liquid level of ink in the sub-tank 53 is equal to or higher than a given position Href and turned off in a case where the position (height) of the liquid level of ink in the sub-tank 53 is lower than the given position Href, an operating signal from the operating section 99 of the operating panel 97, or the like is input to the controller 90 through an input port and in addition, a print job or the like from the user PC 100 is input to the controller 90 through the I/F 95. Here, the given position Href is set, in this embodiment, to be a position where the difference in height (head difference) AH between the liquid level of ink in the sub-tank 53 and the nozzle formation surface 23*a* becomes a given value ΔH1, that is, a position that is lower by the given value ΔH1 than the nozzle formation surface 23*a*. The given value ΔH1 is determined such that in a case where the sub-tank 53 is opened to the air, pressure acting on ink in the nozzle 23 becomes given negative pressure (for example, −1 kPa, −0.8 kPa, or the like) determined as pressure capable of inhibiting intrusion of air from the nozzle formation surface 23*a* side into the nozzles 23 and also inhibiting leakage of ink from the nozzles 23, and can be set to be, for example, 90 mm, 100 mm, 110 mm, or the like. A control signal to the printing head 24, a control signal to the driving motor 33 or the carriage motor 34, a control signal to the lifting and lowering device 48 (refer to FIG. 3) of the capping device 40, a control signal to the supply pump 58, the circulation pump 76, the opening-closing valve 78, or the pressure adjusting device 80 (refer to FIG. 2), a display control signal to the display section 98 of the operating panel 97, or the like is output from the controller 90 through an output port and in addition, print status information or the like is output from the controller 90 to the user PC 100 through the I/F 95.

In the ink jet printer 20 of this embodiment configured in this way, in a case where print processing is performed on the paper P by discharging ink droplets from the plurality of nozzles 23 of the printing head 24, by controlling the supply pump 58, the circulation pump 76, and the opening-closing valve 78 in such a manner that both the supply pump 58 and the circulation pump 76 rotate in the normal rotation direction in a state where the opening-closing valve 78 is opened, ink in the main tank 52 is supplied to the sub-tank 53, and ink in the sub-tank 53 is supplied from the forward path port 69 side to the printing head 24 and also some of the ink is returned from the return path port 73 side to the sub-tank 53 by way of the printing head 24. In this embodiment, as described above, by setting the forward path port 69 of the circulation path 60 to be at a position lower than the return path port 73 of the circulation path 60 or the supply port 56 of the supply path 54, when print processing is performed, air (air bubbles) penetrating from the forward path port 69 into the circulation path 60 and then reaching the printing head 24 is suppressed. In this way, print processing can be more appropriately performed. In addition, as the air bubbles which are generated in the sub-tank 53, there are air bubbles which are contained in ink pumped from the main tank 52 to the sub-tank 53 by way of the supply path 54, air bubbles which are contained in ink that is discharged from the return path port 73 of the circulation path 60 to the sub-tank 53, or the like.

Figure 5:
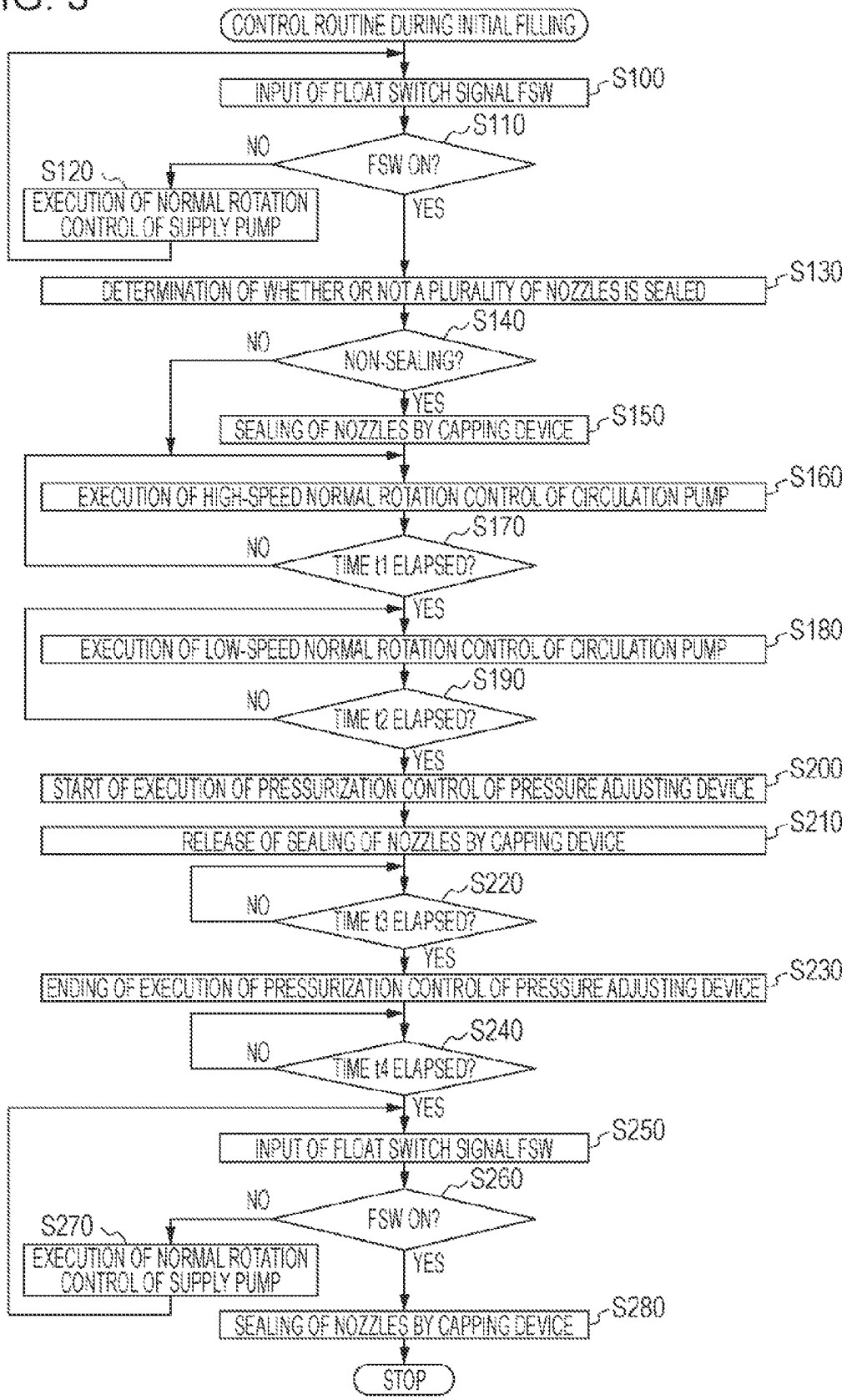
FIG. 5 is a flowchart showing one example of a control routine during initial filling.

Next, an operation of the ink jet printer 20 of this embodiment configured in this way, in particular, an operation at the time of initial filling of the printing head 24 (including the plurality of nozzles 23) with ink will be described. FIG. 5 is a flowchart showing one example of a control routine during initial filling which is executed by the controller 90. This routine is executed when filling of ink to the printing head 24 has been instructed. In addition, at the time of the start of execution of this routine, in this embodiment, the sub-tank 53 is set to be opened to the air by the pressure adjusting device 80 and the opening-closing valve 78 is set to be opened.

If the control routine during initial filling is executed, the controller 90 first inputs a float switch signal FSW from the float switch 59 (Step S100) and also examines the input float switch signal FSW (Step S110), and in a case where the float switch signal FSW is OFF, that is, in a case where the position (height) of the liquid level of ink in the sub-tank 53 is lower than the given position Href that is lower by the given value ΔH1 than the nozzle formation surface 23*a*, the controller 90 controls the supply pump 58 such that the supply pump 58 rotates in the normal rotation direction (such that ink is pumped from the main tank 52 side to the sub-tank 53 side) (Step S120) and then a process is returned to Step S100. The processing in Step S100 to Step S120 is the processing of adjusting pressure (negative pressure) acting on ink in the nozzles 23.

In a case where in Step S110, the float switch signal FSW is ON, that is, in a case where the position (height) of the liquid level of the ink in the sub-tank 53 is equal to or higher than the given position Href, whether or not the plurality of nozzles 23 is sealed by the capping device 40 is determined (Steps S130 and S140), and in a case where a determination that the plurality of nozzles 23 is not sealed is made, the capping device 40 is controlled such that the contact member 44 of the capping device 40 comes into contact with the nozzle formation surface 23*a*, thereby sealing the plurality of nozzles 23 (Step S150). Here, the determination in Steps S130 and S140 can be performed by examining the position of the cap 42 or by examining whether or not the nozzle formation surface 23*a* and the contact member 44 come into contact with each other. In addition, in case where a determination that the plurality of nozzles 23 is sealed is made in Steps S130 and S140, a process proceeds to the next processing without executing the processing of Step S150.

Subsequently, high-speed normal rotation control in which the circulation pump 76 is controlled such that the circulation pump 76 rotates in the normal rotation direction in a given rotation number N1 determined as a relatively high rotation number is executed over a given time t1 (Steps S160 and S170). Here, the given time t1 is determined as a time required for filling of ink of the circulation path 60 including the printing head 24, discharge of air (air bubbles) in the circulation path 60 to the sub-tank 53, or the like, and in this embodiment, the given time t1 is set to be a time required for ink of n times (n is a predetermined integer of 2 or more) the entire volume of the circulation path 60 to circulate in the circulation path 60 when the high-speed normal rotation control is executed. The given time t1 can be set to, for example, 2 minutes, 3 minutes, 4 minutes, or the like. In this manner, by circulating ink in the circulation path 60 by the circulation pump 76 in a state where the plurality of nozzles 23 is sealed by the capping device 40, it is possible to fill the recording head 24 with ink while inhibiting discharge (leakage) of ink from the plurality of nozzles 23. In addition, in this case, it is possible to circulate ink in the circulation path 60 in a relatively large flow rate. Further, since ink of n times the entire volume of the circulation path 60 is circulated in the circulation path 60, compared to a case where ink corresponding to the entire volume of the circulation path 60 is circulated in the circulation path 60, it is possible to more reliably discharge air bubbles in the circulation path 60 to the sub-tank 53. In addition, as described above, since the forward path port 69 of the circulation path 60 is set to be at a position lower than the return path port 73 of the circulation path 60, air (air bubbles) flowing from the forward path port 69 into the circulation path 60 and then reaching the printing head 24 can be suppressed. In addition, since the plurality of nozzles 23 is sealed by the capping device 40, depending on the shapes or the like of the plurality of nozzles 23, there is a possibility that air (air bubbles) in the plurality of nozzles 23 may remain as it is without moving to the return path port 73 side.

If the high-speed normal rotation control is executed in this way, subsequently, low-speed normal rotation control in which the circulation pump 76 is controlled such that the circulation pump 76 rotates in the normal rotation direction in a given rotation number N2 determined as a lower rotation number than the given rotation number N1 is executed over a given time t2 (Steps S180 and S190). Here, the given time t2 is determined as a time required for stability or the like of the flow of ink in the circulation path 60 and can be set to be, for example, 25 seconds, 30 seconds, 35 seconds, or the like.

Next, execution of pressurization control in which the pressure adjusting device 80 is controlled such that the sub-tank 53 is pressurized by the pressure adjusting device 80 is started (Step S200), the capping device 40 is controlled such that sealing of the plurality of nozzles 23 by the capping device 40 is released (Step S210), and the controller 90 waits for a given time t3 to elapse in this state (Step S220). Here, the pressurization control is control in which the sub-tank 53 is pressurized such that pressure acting on ink in the nozzles 23 becomes positive pressure (for example, 10 kPa, 12 kPa, or the like). Further, release of sealing of the plurality of nozzles 23 is for creating a state where the nozzle formation surface 23*a* and the contact member 44 are separated slightly (several mm or the like) from each other, so that a closed space is formed by the nozzle formation surface 23*a* and the cap 42. If sealing of the plurality of nozzles 23 is released while executing the pressurization control in this manner, ink in the sub-tank 53 flows to the printing head 24 side and air (air bubbles) is discharged along with the ink from the plurality of nozzles 23. In addition, the ink discharged from the plurality of nozzles 23 is discharged to the waste liquid tank 45 by way of the clearance between the cap 42 and the contact member 44 or the discharge path 46. By the processing in Steps S200 to S220, it is possible to sufficiently discharge air in the plurality of nozzles 23. The given time t3 is determined as a time required for discharge of air from the plurality of nozzles 23 and can be set to be, for example, 3 seconds, 5 seconds, 7 seconds, or the like. In addition, in this embodiment, since sealing of the plurality of nozzles 23 by the capping device 40 is released after the high-speed normal rotation control or the low-speed normal rotation control is executed, compared to a case where the high-speed normal rotation control or the low-speed normal rotation control is executed without sealing the plurality of nozzles 23, it is possible to suppress the discharge amount of ink from the nozzles 23.

If the given time t3 elapses in this way, execution of the pressurization control is ended, so that a state where the sub-tank 53 is opened to the air is created (Step S230), and the controller 90 waits for a given time t4 to elapse (Step S240). Here, the given time t4 is determined as a time required to stabilize the meniscus of ink in the plurality of nozzles 23 and can be set to be, for example, 8 seconds, 10 seconds, 12 seconds, or the like.

Then, the float switch signal FSW from the float switch 59 is input (Step S250) and also the input float switch signal FSW is examined (Step S260), and in a case where the float switch signal FSW is OFF, the supply pump 58 is controlled such that the supply pump 58 rotates in the normal rotation direction (such that ink is pumped from the main tank 52 side to the sub-tank 53 side) (Step S270) and then a process is returned to Step S250. On the other hand, in a case where in Step S260, the float switch signal FSW is ON, the capping device 40 is controlled such that the plurality of nozzles 23 is sealed by the capping device 40 (Step S280) and this routine is then ended.

Here, the correspondence relationship between the constituent element in this embodiment and the constituent element of the invention is clarified. The printing head 24 in this embodiment is equivalent to a "discharging head", the sub-tank 53 is equivalent to a "storage section", the circulation path 60 is equivalent to a "circulation path", the circulation pump 76 is equivalent to a "pumping section", the capping device 40 is equivalent to a "sealing section", the pressure adjusting device 80 is equivalent to a "pressurization section", and the controller 90 which executes the control routine during initial filling in FIG. 5 is equivalent to a "control-during-filling section". In addition, in this embodiment, one example of a method of controlling the liquid discharging apparatus according to the invention is also clarified by explaining an operation of the liquid discharging apparatus.

According to the ink jet printer 20 related to this embodiment described above, since when filling the printing head 24 with ink, the capping device 40 and the circulation pump 76 are controlled such that ink circulates in the circulation path 60 by driving of the circulation pump 76 in a state where each of the plurality of nozzles 23 is independently sealed by the capping device 40, and thereafter, the pressure adjusting device 80 and the capping device 40 are controlled such that sealing of the plurality of nozzles 23 by the capping device 40 is released while the sub-tank 53 is pressurized by the pressure adjusting device 80, it is possible to fill the printing head 24 with ink while inhibiting discharge of ink from the plurality of nozzles 23 and, thereafter, it is also possible to discharge air (air bubbles) from the plurality of nozzles 23. That is, it is possible to suppress waste of ink when filling the printing head 24 including the plurality of nozzles 23 with ink and it is also possible to sufficiently remove air in the circulation path 60 (including the plurality of nozzles 23).

In addition, the invention is not limited to the embodiment described above and it goes without saying that the invention can be implemented in various aspects as long as they are within the technical scope of the invention.

In the embodiment described above, an operation at the time of initial filling of filling the printing head 24 with ink has been described. However, the same operation may also be performed in a case where cleaning of the printing head 24 is performed. In this case, for example, the given time t1 may also be set to be 50 seconds, 1 minute, 1 minute 10 second, or the like, the given time t2 may also be set to be 25 seconds, 30 seconds, 35 seconds, or the like, the given time t3 may also be set to be 3 seconds, 5 seconds, 7 seconds, or the like, and the given time t4 may also be set to be 8 seconds, 10 seconds, 12 seconds, or the like. In addition, as the timing of executing cleaning of the printing head 24, a time when the main tank 52 or the sub-tank 53 is replaced, a time when cleaning is instructed by operation of the operating section 99, or the like is conceivable.

In the embodiment described above, the high-speed normal rotation control is executed over the given time t1 as a time required for ink equal to or more than n times (n is a predetermined integer of 2 or more) the entire volume of the circulation path 60 to circulate in the circulation path 60 when executing the high-speed normal rotation control. However, high-speed normal rotation control during a given time t11 shorter than the given time t1 may also be executed and high-speed normal rotation control during the given time t1 or the given time t11 may also be executed m times (m is a predetermined integer of 2 or more). Here, the given time t11 can be set to be a time required for ink corresponding to the entire volume of the circulation path 60 to circulate in the circulation path 60 when executing the high-speed normal rotation control, a time slightly longer than this, or the like.

In the embodiment described above, the high-speed normal rotation control is executed over the given time t1 and also the low-speed normal rotation control is executed over the given time t2, and thereafter, sealing of the plurality of nozzles 23 by the capping device 40 is released while pressurizing the sub-tank 53 by the pressure adjusting device 80. However, sealing of the plurality of nozzles 23 by the capping device 40 may also be released while pressurizing the sub-tank 53 without executing the low-speed normal rotation control after the high-speed normal rotation control is executed over the given time t1.

In the embodiment described above, the supply pump 58 is controlled as necessary to wait for the given time t4 to elapse after execution of the pressurization control is ended. However, the supply pump 58 may also be controlled as necessary without waiting for the given time t4 to elapse after execution of the pressurization control is ended.

In the embodiment described above, ink is pumped from the main tank 52 to the sub-tank 53 as necessary after execution of the pressurization control is ended. However, setting may be also be made such that after execution of the pressurization control is ended, ink is not pumped from the main tank 52 to the sub-tank 53.

Figure 6:
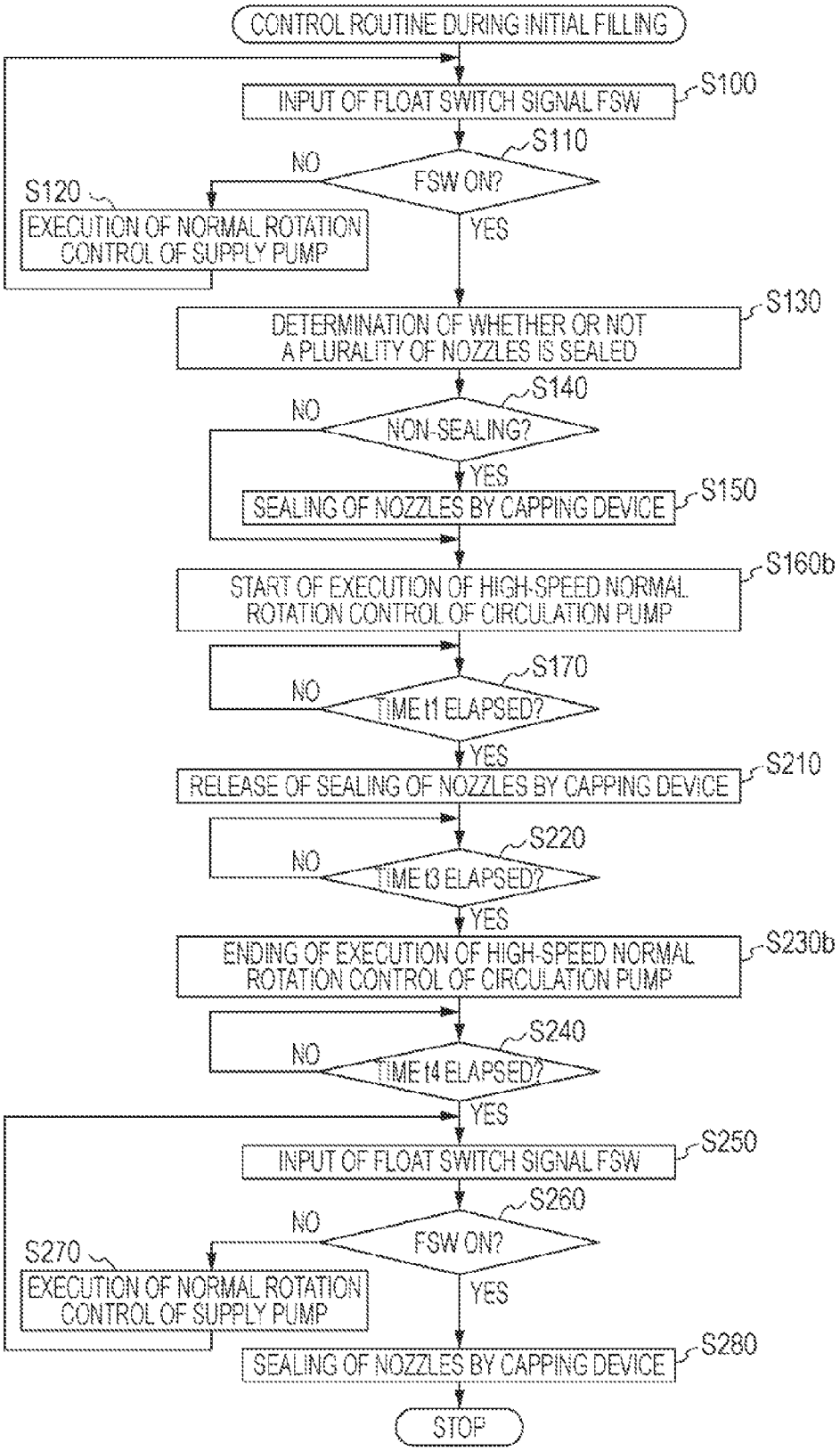
FIG. 6 is a flowchart showing one example of a control routine during initial filling.

In the embodiment described above, sealing of the plurality of nozzles 23 by the capping device 40 is released while pressurizing the sub-tank 53 by the pressure adjusting device 80 after the high-speed normal rotation control or the low-speed normal rotation control is executed. However, sealing of the plurality of nozzles 23 by the capping device 40 may also be released while rotating the supply pump 58 in the normal rotation direction, and sealing of the plurality of nozzles 23 by the capping device 40 may also be released while pressurizing the sub-tank 53 by the pressure adjusting device 80 and also rotating the supply pump 58 in the normal rotation direction. One example of the control routine during initial filling in the former case is shown in FIG. 6. This routine is the same as the control routine during initial filling of FIG. 5 except for the point that the processing in Steps S180 to S200 of the control routine during initial filling in FIG. 5 is not executed and the processing in Steps S160*b* and S230*b* is executed in place of the processing in Steps S160 and S230. Therefore, the same processing is denoted by the same step number and the detailed explanation thereof is omitted. In this control routine during initial filling, in a state where the position (height) of the liquid level of ink in the sub-tank 53 is equal to or higher than the given position Href that is lower by the given value ΔH1 than the nozzle formation surface 23*a* and the plurality of nozzles 23 is sealed by the capping device 40 (Steps S100 to S150), execution of the high-speed normal rotation control in which the circulation pump 76 is controlled such that the circulation pump 76 rotates in the normal rotation direction in the given rotation number N1 is started (Step S160*b*), the controller 90 waits for the given time t1 to elapse (Step S170), the capping device 40 is controlled such that sealing of the plurality of nozzles 23 by the capping device 40 is released (Step S210), the controller 90 waits for the given time t3 to elapse in the state (Step S220), the execution of the high-speed normal rotation control is ended (Step S230*b*), and the processing of Step S240 or later is executed. In this case, by releasing sealing of the plurality of nozzles 23 by the capping device 40 while circulating ink in the circulation path 60, it is possible to discharge ink along with air (air bubbles) from the plurality of nozzles 23. Therefore, similarly to the embodiment described above, it is possible to fill the printing head 24 with ink while inhibiting discharge of ink from the plurality of nozzles 23 and, thereafter, it is also possible to discharge air from the plurality of nozzles 23. That is, it is possible to suppress waste of ink when filling the printing head 24 including the plurality of nozzles 23 with ink and it is also possible to sufficiently remove air in the circulation path 60 (including the plurality of nozzles 23). In addition, in this case, a configuration may also be made in which the sub-tank 53 is opened to the air without being provided with the pressure adjusting device 80. Further, in the control routine during initial filling of FIG. 6, a case where sealing of the plurality of nozzles 23 by the capping device 40 is released while rotating the supply pump 58 in the normal rotation direction has been described. However, if a configuration is made in which sealing of the plurality of nozzles 23 by the capping device 40 is released while pressurizing the sub-tank 53 by the pressure adjusting device 80 and also rotating the supply pump 58 in the normal rotation direction, it is considered that air in the plurality of nozzles 23 can be more reliably removed. In this modified example, the number of rotations of the circulation pump 76 when circulating ink in the circulation path 60 in a state where the plurality of nozzles 23 is sealed by the capping device 40 and the number of rotations of the circulation pump 76 when releasing sealing of the plurality of nozzles 23 by the capping device 40 are set to be the same given rotation number N1. However, the number of rotations of the circulation pump 76 when releasing sealing of the plurality of nozzles 23 may also be set to be a higher rotation number than the given rotation number N1. According to this, it is possible to more reliably remove air in the plurality of nozzles 23 from the nozzles 23. Further, in this modified example, sealing of the plurality of nozzles 23 by the capping device 40 is released after waiting for elapse of the given time t1 since the start of execution of the high-speed normal rotation control. However, sealing of the plurality of nozzles 23 by the capping device 40 may also be released after waiting for elapse of the above-mentioned given time t11 since the start of execution of the high-speed normal rotation control, and sealing of the plurality of nozzles 23 by the capping device 40 may also be released while executing the high-speed normal rotation control after the high-speed normal rotation control during the given time t1 or the given time t11 is executed m times (m is a predetermined integer of 2 or more). Further, in this modified example, the supply pump 58 is controlled as necessary to wait for the given time t4 to elapse after execution of the high-speed normal rotation control is ended. However, the supply pump 58 may also be set to be controlled as necessary without waiting for the given time t4 to elapse after execution of the high-speed normal rotation control is ended, and setting may also be made such that after execution of the high-speed normal rotation control is ended, the supply pump 58 is not controlled.

In the embodiment described above, the forward path port 69 of the circulation path 60 is set to be lower than the return path port 73. However, the heights of the forward path port 69 and the return path port 73 may also be set to be approximately equal to each other.

In the embodiment described above, the supply pump 58 is set to use a gear pump. However, a tube pump or the like may also be used. The circulation pump 76 may also be set to use a tube pump or the like in the same way.

In the embodiment described above, the ink circulation system 50 is set to include the main tank 52, the sub-tank 53, the supply path 54, the supply pump 58, the circulation path 60, the circulation pump 76, the opening-closing valve 78, and the pressure adjusting device 80. However, the ink circulation system 50 may also be set not to include the main tank 52, the supply path 54, and the supply pump 58.

In the embodiment described above, the ink jet printer 20 having a single printing head 24 has been described. However, the invention may also be applied to an ink jet printer having a plurality of printing heads.

In the embodiment described above, an example in which the liquid discharging apparatus according to the invention is embodied in the ink jet printer 20 has been shown. However, the liquid discharging apparatus according to the invention may also be embodied in a fluid discharging apparatus which discharges liquid other than ink, a liquid body (dispersion liquid) in which functional material particles are dispersed, a fluid body such as gel, or the like. For example, a liquid discharging apparatus which discharges liquid in which a material such as an electrode material or a color material which is used for the manufacturing or the like of a liquid crystal display, an EL (electroluminescence) display, and a surface-emitting display is dissolved, a liquid body discharging apparatus which discharges a liquid body in which the same material is dispersed, or a liquid discharging apparatus which is used as a precision pipette and discharges liquid that becomes a sample is also acceptable. Further, a liquid discharging apparatus which discharges lubricant to a precision machine such as a clock or a camera by a pin point, a liquid discharging apparatus which discharges transparent resin solution such as ultraviolet curing resin onto a substrate in order to form a hemispherical micro-lens (an optical lens) or the like which is used in an optical communication element or the like, a liquid discharging apparatus which discharges etching solution such as acid or alkali in order to etch a substrate or the like, or a fluid body discharging apparatus which discharges gel is also acceptable.

In the embodiment described above, the liquid discharging apparatus according to the invention has been described being applied to the ink jet printer 20. However, it is not limited thereto, and it is acceptable if it is the form of a liquid discharging apparatus which is provided with a discharging head having nozzles which discharge liquid, and the invention may be applied to any other OA equipment such as a facsimile machine or a complex machine, for example.

What is claimed is:

1. A method of controlling a liquid discharging apparatus that includes a discharging head having a plurality of nozzles which discharge liquid; a storage section which stores the liquid; a circulation flow path having the discharging head, the storage section, a first flow path through which the liquid is supplied from the storage section to the discharging head, and second flow path through which the liquid flows back to the storage section from the discharging head; a pump that circulates the liquid through the circulation flow path; a sealing member capable of sealing each of the plurality of nozzles; and a pressurization section capable of pressurizing the storage section, the method comprising:

a first process of sealing each of the plurality of the nozzles using the sealing member;

a second process of executing a first rotation control in which the pump is controlled such that the pump rotates at a first rotational rate after the first process is completed;

a third process of executing a second rotation control in which the pump is controlled such that the pump rotates at a second rotational rate after the second process is complete, the second rotational rate being lower than the first rotational rate;

a fourth process of pressurizing the storage section using the pressurization section after the third process is completed;

a fifth process of releasing the sealing of each of the plurality of the nozzles after the fourth process is completed; and a sixth process of stopping the pressurizing of the storage section after the fifth process is completed.

2. The method of controlling a liquid discharging apparatus according to the claim 1, wherein the second process is executed during a first time that is set to be a time required for the liquid equal to or more than a plurality times an entire volume of the circulation flow path circulates in the circulation flow path.

3. The method of controlling a liquid discharging apparatus according to the claim 2, wherein the third process is executed during a second time that is a shorter time than the first time.

4. The method of controlling a liquid discharging apparatus according to the claim 3, wherein the sixth process is executed after the elapse of a third time after the fifth process is completed, the third time being a shorter time than the second time.

5. A liquid discharging apparatus, comprising:

a discharging head having a plurality of nozzles which discharge liquid;

a storage section which stores the liquid;

a circulation flow path having the discharging head, the storage section, a first flow path through which the liquid is supplied from the storage section to the discharging head, and second flow path through which the liquid flows back to the storage section from the discharging head;

a pump that circulates the liquid through the circulation flow path;

a sealing member capable of sealing each of the plurality of nozzles;

a pressurization section capable of pressurizing the storage section; and a controller that commands the sealing member to seal each of the plurality of the nozzles, then executes a first rotation control in which the pump is controlled such that the pump rotates at a first rotational rate, then executes a second rotation control in which the pump is controlled such that the pump rotates at a second rotational rate that is lower than the first rotational rate, then commands the pressurization section to pressurize the storage section, then commands the sealing member to release the sealing of each of the plurality of the nozzles, and then commands the pressurization section to stop the pressurizing of the storage section.

* * * * *